US008199030B2

(12) United States Patent
Dunsky

(10) Patent No.: US 8,199,030 B2
(45) Date of Patent: Jun. 12, 2012

(54) STRANDED AIRCRAFT ALERTS MODULE

(75) Inventor: Ron Dunsky, Brooklyn, NY (US)

(73) Assignee: PASSUR Aerospace, Inc., Stamford, CT (US)

( * ) Notice: Subject to any disclaimer, the term of this patent is extended or adjusted under 35 U.S.C. 154(b) by 394 days.

(21) Appl. No.: 12/509,883

(22) Filed: Jul. 27, 2009

(65) Prior Publication Data

US 2010/0045485 A1 Feb. 25, 2010

Related U.S. Application Data

(60) Provisional application No. 61/084,101, filed on Jul. 28, 2008.

(51) Int. Cl.
*G08B 21/00* (2006.01)

(52) U.S. Cl. ..... 340/945; 340/958; 340/963; 340/971; 701/120

(58) Field of Classification Search ..... 340/945, 340/958, 963, 971; 701/120; 342/36
See application file for complete search history.

(56) References Cited

U.S. PATENT DOCUMENTS

2002/0178018 A1* 11/2002 Gillis et al. ..... 705/1
2004/0039613 A1* 2/2004 Maycotte et al. ..... 705/5
2009/0118997 A1* 5/2009 Truitt ..... 701/120

* cited by examiner

*Primary Examiner* — Brent Swarthout
(74) *Attorney, Agent, or Firm* — Fay Kaplun & Marcin, LLP

(57) ABSTRACT

An alerts module having a memory storing aircraft data, the aircraft data including identities of aircraft that are grounded and a processor comparing the aircraft data to predetermined rules for determining whether an aircraft is stranded and generating an alert for each of the aircraft that are determined to be stranded, wherein the alert includes the identify of the aircraft that is stranded.

20 Claims, 16 Drawing Sheets

| Concourse | | 0900 | 1000 | 1100 | 1200 | 1300 | 1400 | 1500 | 1600 |
|---|---|---|---|---|---|---|---|---|---|
| CN-A | Arr | 15 16 | 9 11 | 10 14 | 15 20 | 8 13 | 4 20 | 2 8 | 2 20 |
| | Dep | 19 19 | 13 32 | 22 18 | 2 14 | 19 | 22 | 20 | 16 |
| CN-B | Arr | 41 48 | 34 34 | 24 29 | 16 18 | 19 23 | 10 36 | 3 16 | 32 |
| | Dep | 12 7 | 43 60 | 38 39 | 24 27 | 21 | 25 | 29 | 15 |
| CN-C | Arr | 3 9 | 11 10 | 7 8 | 6 8 | 9 10 | 5 6 | 9 | 9 |
| | Dep | 9 9 | 6 9 | 8 9 | 4 7 | 8 | 7 | 13 | 5 |
| CARG | Arr | | | | | | | | |
| | Dep | | | | | | | | |
| Total | Arr | 59 73 | 54 55 | 41 51 | 37 46 | 38 48 | 12 52 | 5 33 | 2 81 |
| | Dep | 40 35 | 62 101 | 68 | | | | | 36 |
| | Ops | 99 108 | 116 108 | 109 | | | | | 97 |

105

Cur

From F I G. 2A

| | |
|---|---|
| Current (METAR) | 1153 WIND from 200 at 11KT<br>KDEN 151853Z 20011KT 10SM FEW070 BKN120 BKN200 06/M11 A2965 RMK AO2 SLP029 VIGRA |
| Forecast (TAF) | 1100 -> 1400 WIND from 230 at 13KT GUSTING 20KT<br>1400 -> 1600 WIND from 300 at 14KT GUSTING 22KT<br>1600 -> 1900 WIND from 030 at 12KT<br>1900 -> 2300 WIND from 360 at 14KT GUSTING 22KT SHOWERS IN VICINITY<br>2300 -> 0000 WIND from 010 at 15KT GUSTING 22KT LIGHT SNOW MIST<br>0000 -> 0400 WIND from 010 at 15KT GUSTING 22KT LIGHT SNOW MIST<br>0400 -> 0800 WIND from 020 at 14KT GUSTING 22KT LIGHT SNOW MIST<br>0800 -> 1100 WIND from 010 at 16KT GUSTING 22KT SHOWERS IN VICINITY<br><br>KDEN 151735Z 151818 23013G20KT P6SM FEW080 BKN140 BKN200<br>FM2100 30014G22KT P6SM FEW070 SCT120 BKN200<br>FM2300 03012KT P6SM FEW070 SCT120<br>FM0200 36014G22KT P6SM VCSH SCT035 OVC050<br>FM0600 01015G22KT 4SM - SN BR SCT014 OVC025<br>TEMPO 071SM - SN BR SCT007 OVC012<br>FM1100 02014G22KT 2SM - SN BR SCT012 BKN025 OVC050<br>FM1500 01016G26KT P6SM VCSH SCT0252 BKN050 |

To F I G. 2C

F I G. 2B

400

HOME OPSnet Powered by Passur | DEN | 1236L 1936Z | STRANDED AIRCRAFT SCREEN

Stranded Aircraft

| Arrivals | | | | | Departures | | | | |
|---|---|---|---|---|---|---|---|---|---|
| **Flight** | **FR** | **SKD** | **ATA** | **Delay** | **Flight** | **FR** | **SKD** | **PB** | **Delay** |
| | | 90+ | | | | | 120+ | | |
| EGF310 | SF34 | 11:20 | 11:45 | 98 min | EGF477 | AMA | 11:51 | 11:35 | 126 min Note |
| AAL2306 | EGE | 11:20 | 11:45 | 92 min | | | 90+ | | |
| | | 60+ | | | AAL2229 | HDN | 11:47 | 11:30 | 110 min |
| AAL1452 | OAK | 11:21 | 11:45 | 77 min | AAL1119 | SMF | 11:46 | 11:30 | 102 min |
| USA1772 | CLT | 11:22 | 11:28 | 69 min | AAL1847 | DEN | 11:46 | 11:30 | 99 min |
| AAL2193 | DCA7 | 11:23 | 11:25 | 61 min | EGF213 | CLL | 11:42 | 11:15 | 93 min |
| | | 30+ | | | | | 60+ | | |
| EGF792 | XNA | 11:23 | 11:35 | 52 min | AAL1717 | AUS | 11:42 | 11:30 | 82 min |
| AAL1770 | PHX | 11:26 | 11:50 | 47 min | AAL1726 | CMH | 11:42 | 11:30 | 75 min |
| COA1133 | EWR | 11:26 | 11:35 | 41 min | EGF713 | JAN | 11:41 | 11:25 | 63 min |
| AAL1242 | SJC | 11:26 | 11:55 | 32 min | AAL1436 | CLT | 11:41 | 11:25 | 52 min |

410

Set Arrival Alert Parameters

Set Departure Alert Parameters

Create/Edit Email Alert List

1046 Inland - I have just updated the deicing fluid inventory totals.

Send

F I G. 4B

ATC PORTAL EWR ATC Portal Live

500

Archive Search

Starting Date:
Month Day Year
January 01 08
Hour: 00 Min: 00

Ending Date:
Month Day Year
January 31 08
Hour: 00 Min: 00

(Optionally) Search By:

- [ ] Efficiency Score
- [x] Arrival Rate
  >= 40
- [ ] Departure Rate
- [x] Number of Holds
  >= 40
- [ ] Arrival Runway Config.
- [x] Departure Runway Config.

| Alert | Time/ Date | Efficiency Event | Efficiency 6 Mon Avg | Arrival Event | Arrival 6 Mon Avg | Departure Event | Departure 6 Mon Avg | Hold |
|---|---|---|---|---|---|---|---|---|
| | 15:15 Jan 01 | 91.1 | 81 | 40 (10) | 37 | 20 (5) | 28 | 0 |
| | 15:30 Jan 01 | 85 | 81 | 44 (11) | 37 | 12 (3) | 28 | 0 |
| | 15:45 Jan 01 | 83.2 | 81 | 40 (10) | 37 | 24 (6) | 28 | 0 |
| | 16:00 Jan 01 | 82.5 | 80 | 40 (10) | 37 | 24 (6) | 29 | 1 |
| | 17:30 Jan 01 | 87.3 | 78 | 40 (10) | 36 | 28 (7) | 28 | 5 |
| | 18:15 Jan 01 | 76.7 | 77 | 40 (10) | 36 | 24 (6) | 28 | 1 |
| | 19:30 Jan 01 | 73.5 | 76 | 40 (10) | 27 | 28 (7) | 24 | 0 |
| | 20:00 Jan 01 | 76.8 | 75 | 40 (10) | 26 | 24 (6) | 24 | 0 |
| | 20:15 Jan 01 | 78 | 75 | 40 (10) | 27 | 32 (8) | 27 | 0 |
| | 20:30 Jan 01 | 80.8 | 75 | 40 (40) | 28 | 36 (9) | 27 | 0 |

To FIG. 5B

To FIG. 5C

FIG. 5A

From FIG. 5A

500

Compare to:

◉ Historical Average

6 Month Average ✓

○ Scenario

Search

Download to File or Spreadsheet

| | | | | | | | |
|---|---|---|---|---|---|---|---|
| 20:45 Jan 01 | 80.9 | 78 | 44 (11) | 30 | 36 (9) | 30 | 0 |
| 21:00 Jan 01 | 77 | 78 | 40 (10) | 33 | 24 (6) | 32 | 0 |
| 22:15 Jan 01 | 76 | 75 | 44 (11) | 30 | 28 (7) | 33 | 0 |
| 15:30 Jan 01 | 11A | 75 | 44 (11) | 32 | 32 (8) | 32 | 1 |
| 21:15 Jan 01 | 67.3 | 76 | 40 (10) | 36 | 36 (9) | 36 | 3 |
| 12:15 Jan 01 | 11A | 73 | 40 (10) | 29 | 8 (2) | 24 | 0 |
| 14:15 Jan 01 | 68.2 | 77 | 44 (11) | 29 | 28 (7) | 24 | 5 |
| 14:30 Jan 01 | 70.5 | 78 | 44 (11) | 35 | 16 (4) | 25 | 1 |
| 14:45 Jan 01 | 94.7 | 78 | 44 (11) | 36 | 24 (6) | 26 | 0 |
| 15:15 Jan 01 | 84.8 | 78 | 40 (40) | 36 | 36 (9) | 27 | 0 |
| 16:45 Jan 01 | 106.7 | 84 | 40 (10) | 33 | 28 (7) | 31 | 0 |
| 17:00 | 71.8 | 81 | 40 | 36 | 32 | 31 | |

Total Matching results: Results 1 - 50 of 437 More Results 1 2 3 4 5 6 7 8 9

To FIG. 5D

F I G. 5C

600

Archive Search

Starting Date:

Month: March ✓ Day: 04 ✓ Year: 08 ✓

Hour: 00 ✓ Min: 00 ✓

Ending Date:

Month: March ✓ Day: 05 ✓ Year: 08 ✓

Hour: 00 ✓ Min: 00 ✓

(Optionally) Search By:

- Flight Number
- Airline ☑
- Arrive/Depart ☑
- Runway ☑
- Aircraft Type ☑
- Origin ☑
- Tail Number

| Date | Time | Flight | FR | SKD | PB | Delay | Eff | Arr. Rate | Arr. Rate |
|---|---|---|---|---|---|---|---|---|---|
| 03:17 | 11:00 | EGF477 | AMA | 11:51 | 11:35 | 126 min | 89.9 | 16 (4) | 12 (3) |
| | | AAL2229 | HDN | 11:47 | 11:30 | 110min | 91.9 | 20 (5) | 24 (6) |
| | | AAL1119 | SMF | 11:46 | 11:30 | 102 min | 84.2 | 43 (12) | 92 (23) |
| | | AAL1847 | DEN | 11:46 | 11:30 | 99 min | 87.6 | 58 (14) | 88 (22) |
| | | EGF213 | CLL | 11:42 | 11:15 | 93 min | 97.4 | 63 (17) | 84 (21) |
| | | AAL1717 | AUS | 11:42 | 11:30 | 82 min | 97.3 | 80 (20) | 40 (10) |
| | | AAL1726 | CMH | 11:42 | 11:30 | 75 min | 91.2 | 72 (18) | 68 (17) |
| | | EGF713 | JAN | 11:41 | 11:25 | 69 min | 91.4 | 84 (21) | 68 (17) |
| | | AAL1436 | CLT | 11:41 | 11:25 | 62 min | 95.9 | 56 (14) | 60 (15) |

To FIG. 6B

To FIG. 6C

F I G. 6A

From FIG. 6A

600

- [x] Efficiency Score
- [ ] Arrival Rate
- [ ] Departure Rate
- [ ] Number of Holds
- [ ] Arrival Runway Config.
- [ ] Departure Runway Config.

Search

Download to File or Spreadsheet

| | | | | | | | | |
|---|---|---|---|---|---|---|---|---|
| 11:15 | EGF310 | SF34 | 11:20 | 11:45 | 99 min | 91.7 | 68 (17) | 76 (19) |
| | AAL2306 | EGE | 11:20 | 11:45 | 93 min | 84.8 | 64 (16) | 84 (21) |
| | AAL1452 | OAK | 11:21 | 11:45 | 82 min | 88.4 | 44 (11) | 64 (16) |
| | USA1772 | CLT | 11:22 | 11:28 | 75 min | 99.3 | 60 (15) | 84 (21) |
| | AAL2193 | DCA7 | 11:23 | 11:25 | 69 min | 92.5 | 60 (15) | 76 (19) |
| | EGF792 | XNA | 11:23 | 11:35 | 62 min | 99.6 | 68 (17) | 56 (14) |
| | EGF310 | SF34 | 11:20 | 11:45 | 99 min | 80.8 | 72 (18) | 32 (8) |
| | AAL2306 | EGE | 11:20 | 11:45 | 93 min | 101.4 | 58 (17) | 76 (19) |
| | AAL1452 | OAK | 11:21 | 11:45 | 82 min | 96.1 | 56 (14) | 64 (16) |

Total Matching results: Results 1 - 50 of 54 More Results 1 2

To FIG. 6D

F I G. 6C

STRANDED AIRCRAFT ALERTS MODULE

PRIORITY CLAIM/INCORPORATION BY REFERENCE

The present application claims priority to U.S. Provisional Patent Application 61/084,101 filed on Jul. 28, 2008 entitled "Stranded Aircraft Alerts Module" naming Ron Dunsky as inventor, and hereby incorporates, by reference, the entire subject matter of the Provisional Application.

BACKGROUND

An air traffic monitoring system may enable an airport to provide a variety of information and generate an efficient handling of incoming and outgoing aircrafts, in particular when the air traffic monitoring system is configured with real time data. However, conventional air traffic monitoring systems are not equipped with an ability for generating an alert to a presence of an aircraft that remains grounded for extended periods. For example, a taxiing aircraft may be held up for an extended time until a window becomes available for the aircraft to leave.

SUMMARY OF THE INVENTION

An alerts module having a memory storing aircraft data, the aircraft data including identities of aircraft that are grounded and a processor comparing the aircraft data to predetermined rules for determining whether an aircraft is stranded and generating an alert for each of the aircraft that are determined to be stranded, wherein the alert includes the identify of the aircraft that is stranded.

A computer readable storage medium including a set of instructions executable by a processor. The set of instructions operable to receive aircraft data, the aircraft data including identities of aircraft that are grounded, compare the aircraft data to predetermined rules for determining whether an aircraft is stranded and generate an alert for each of the aircraft that are determined to be stranded, wherein the alert includes the identity of the aircraft that is stranded.

DESCRIPTION OF THE DRAWINGS

FIGS. 2A-2C show an alert for the stranded aircraft alerts module according to an exemplary embodiment of the present invention.

FIG. 4*b* shows an indication of a note for the set of data of FIG. 4*a* according to an exemplary embodiment of the present invention.

FIGS. 5A-5D show data associated with the stranded aircraft alerts module according to an exemplary embodiment of the present invention.

FIGS. 6A-6D show a summary for the stranded aircraft alerts module according to an exemplary embodiment of the present invention.

DETAILED DESCRIPTION

Figure 1:
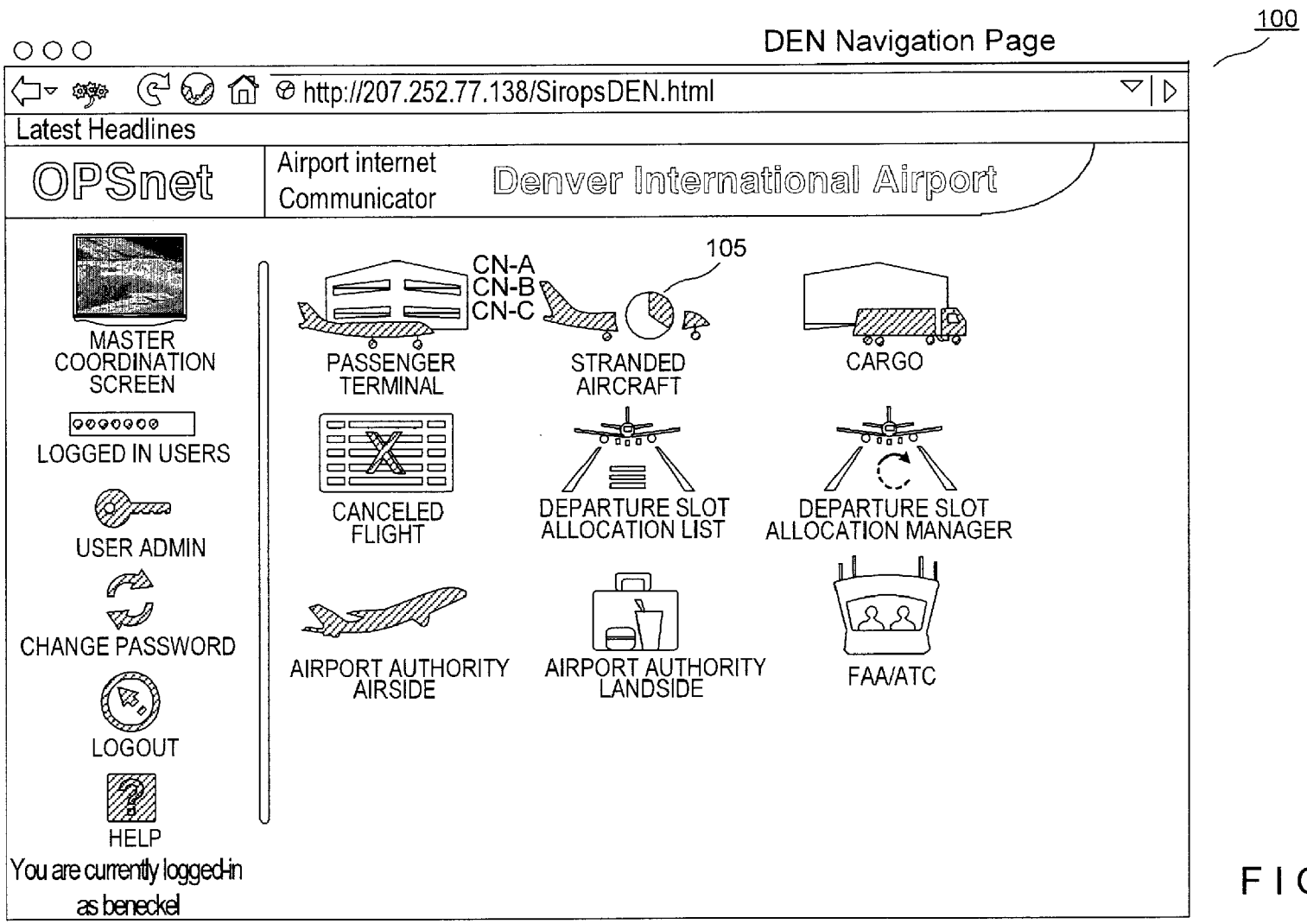
FIG. 1 shows a user interface with an option for a stranded aircraft interface according to an exemplary embodiment of the present invention.

The exemplary embodiments of the present invention may be further understood with reference to the following description and the appended drawings, wherein like elements are referred to with the same reference numerals. The exemplary embodiments of the present invention describe a stranded aircraft alerts module that provides an interface that incorporates aircraft traffic data to generate alerts and other pertinent derived data from the aircraft traffic data. The stranded aircraft alerts module, the interface, the aircraft traffic data, the alerts, and the derived data will be discussed in further detail below.

It should be noted that the term "grounded" will be used throughout this description to describe the status of an aircraft. This term means that the aircraft is not at a gate, but also not in the air. That is, the term "grounded" when referring to a departing aircraft indicates that the aircraft has pushed away from its gate, but has not yet taken off. The term "grounded" when referring to an arriving aircraft indicates that the aircraft has landed, but has not yet arrived at its destination gate.

As will be discussed in further detail below, the stranded aircraft alerts module may enable an airport that utilizes the module to proactively assist carriers in preventing an extended stranding of passengers aboard an aircraft. The stranded aircraft alerts module may also derive data to generate an independent picture of current stranded aircraft statuses for airport managers. In addition, the aircraft alerts module may allow airport managers to analyze stranded aircraft data that have occurred to enable improved responses and outcomes should a substantially similar event arise. Furthermore, the aircraft alerts module may allow the airport to respond to passenger demands and/or political efforts to mitigate severe and publicized aspects relating to stranded aircrafts.

The stranded aircraft alerts module may be embodied in a processor that executes a program stored in the module. Thus, in an exemplary embodiment, the stranded aircraft alerts module may be run on a server of a network. In particular, the network may be for an airport. In another example, the network may be a private network for access by airline carriers and airport managers. The stranded aircraft alerts module may also be a module which is associated with the server of the network. That is, the module may be a self-contained processing unit that is used in association with an already existing system. Data related with the stranded aircraft alerts module may be stored on a remote database or a memory incorporated with the module. It should be noted that the exemplary embodiments described above in which the stranded aircraft alerts module being used on or with a server of a network is only exemplary. In other embodiments, the stranded aircraft alerts module may be a stand alone computing unit that acts independently of an airport network but receives data relating to flights of the airport.

FIG. 1 shows a user interface 100 with an option for a stranded aircraft interface 105 according to an exemplary embodiment of the present invention. The user interface 100 may be a home page for the aircraft alerts module that enables a user to select an option. In addition to conventional options such as passenger terminals, cargo, cancelled flights, departure slot allocation list, departure slot allocation manager, airport authority airside, airport authority landside, and a link to the Federal Aviation Administration (FAA) and/or Air Traffic Control (ATC), the user interface 100 may additionally include the option to select the stranded aircraft interface 105.

Figure 2A:
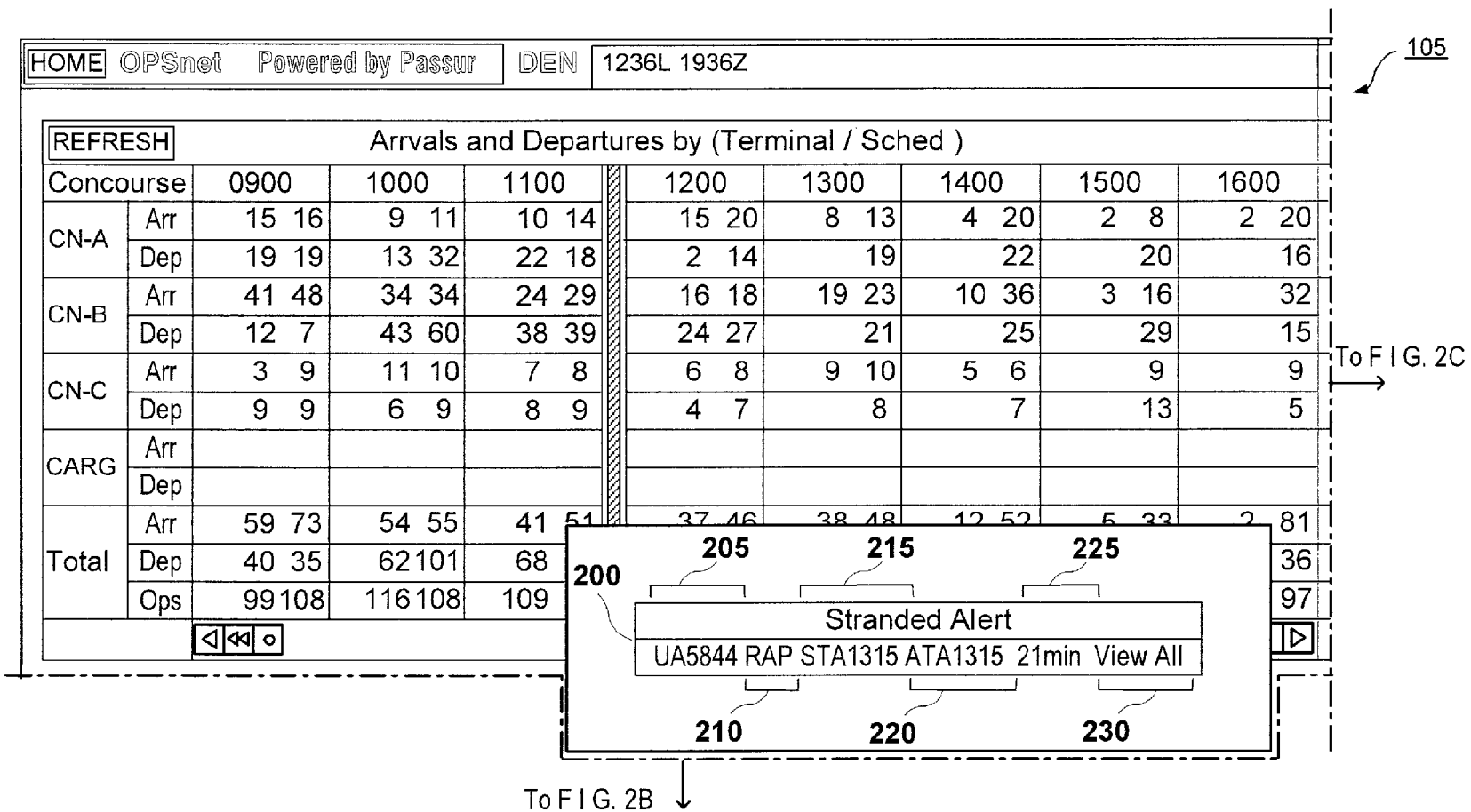
Figure 2C:
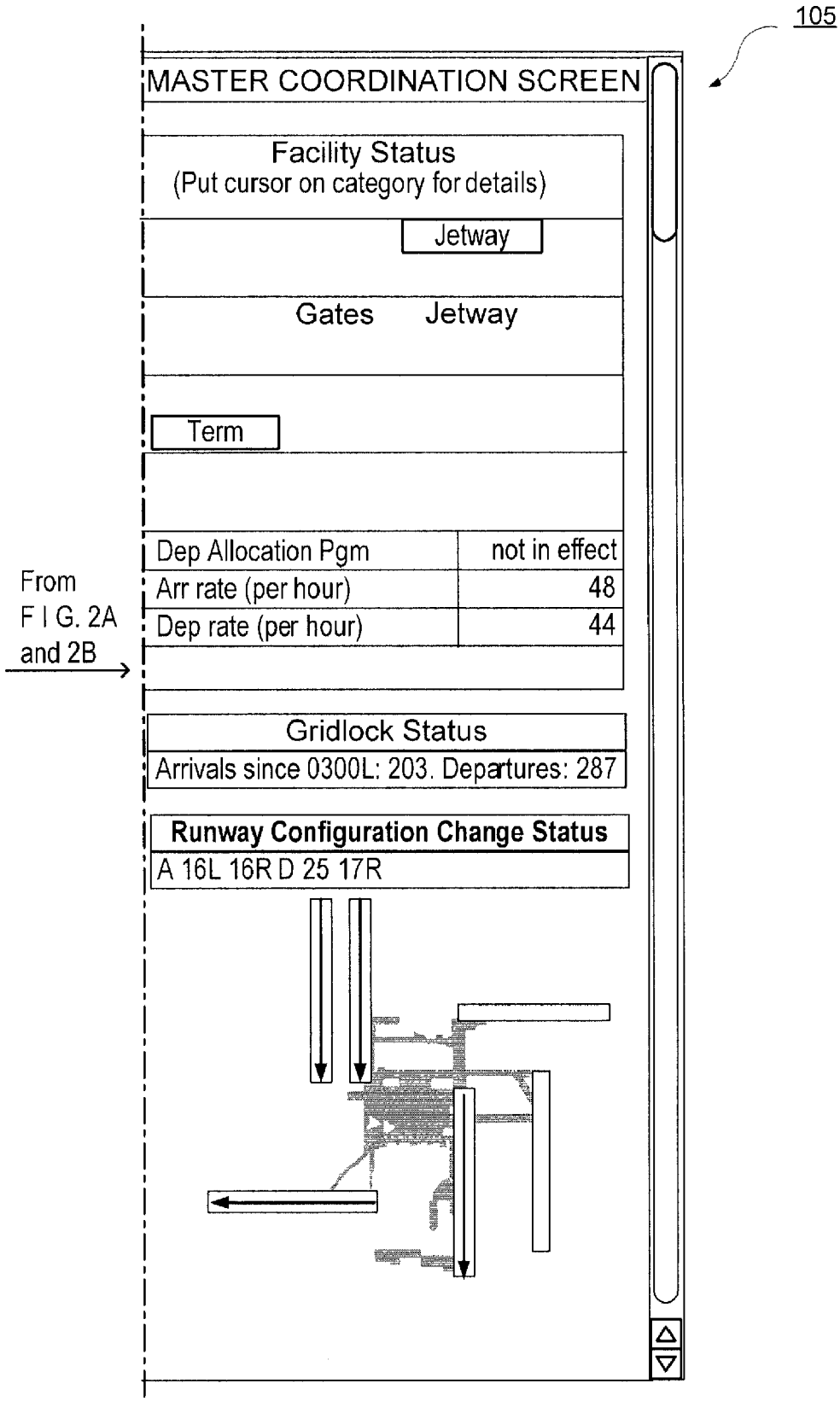

FIGS. 2A-2C show an alert 200 for the stranded aircraft alerts module according to an exemplary embodiment of the present invention. When the stranded aircraft interface 105 is selected from the user interface 100, the stranded aircraft alerts module may present the stranded aircraft interface 105. As illustrated, the stranded aircraft interface 105 may present a variety of data. The stranded aircraft alerts module may be configured with parameters that indicate whether an aircraft is currently stranded. The parameters to determine whether an aircraft is stranded may include a difference for departing aircraft between a block-out time (a time at which the aircraft is pushed away from a gate) and a wheels-up time (a time at which the wheels of the aircraft are retracted), or, for arriving aircraft, a difference between a wheels-down time (a time at which the wheels of the aircraft have been lowered and a block-in time (a time at which the aircraft is locked at a gate). However, it is noted that more properly, for departing aircraft the difference may be the block-out time without a further indication of a wheels-up time. That is, the amount of time the aircraft has been grounded (e.g., the aircraft has pushed away from the gate, but it has not taken off). Similarly, for arriving aircraft the difference may be the wheels-down time without a further indication of a block-in time. However, it should be noted that even after the corresponding times are recorded (i.e., block-out/wheels-up or wheels-down/block-in), the time difference may still be calculated for historical purposes such as determining an average time that aircraft are grounded, etc. Thus, when the time differences are referred to in this description, it may be the time difference based on received data (e.g., block-out time 13:22/wheels-up time 14:02=00:40 time difference) or a time difference based on partially received data and a current time (e.g., block-out time 13:22/current time without receiving wheels-up time 14:12=00:50 time difference). However, in each of these cases, this will be referred to as a time difference between a block-out time and a wheels-up time.

These differences in time may be compared to predetermined rules related to grounded aircraft and stranded aircraft. These predetermined rules may include rules related to a minimum acceptable time in which the aircraft is delayed for departure at which the aircraft is not considered stranded or a minimum acceptable time in which the aircraft is delayed for arrival at which the aircraft is not considered stranded.

The data for determining a grounded status may be derived from a variety of sources. For example, block-in/block-out data may come from sensors at each gate that are deployed by the entity that is providing the stranded aircraft alert or by a third party that has deployed sensors at the gate for a different reason. These sensors may include, for example, switches that are engaged at block-in and disengaged at block-out, RFID readers that read RFID tags on aircraft including range data to determine location of the aircraft with respect to the gate, digital imaging sensors that determine aircraft location with respect to the gate, location and movement data generated from passive radar at the airport site, etc. Similarly, a variety of data sources may be used to determine wheels-up/wheels-down data such as FAA data feeds, airline data feeds, airport data feeds, etc. Also, it is noted that while the exemplary embodiments employ the use of block-in/block-out and wheels-up/wheels-down data to determine a grounded status, there may be other types of data that can be used to determine grounded status. For example, location data may be used to determine that an aircraft is not at a gate and a combination of location and altitude information may be used to determine that the aircraft has taken off or landed. Thus, there may be a variety of data that may be used to determine a grounded status for an aircraft.

Thus, in a first exemplary embodiment, the alert 200 may be automatically generated and shown on the stranded aircraft interface 105. When the stranded aircraft alerts module determines that an aircraft is stranded, the alert 200 may be presented on the stranded aircraft interface 105. In a first exemplary embodiment as shown in FIGS. 2A-2C, the alert 200 may be superimposed over the stranded aircraft interface 105. The superimposed alert 200 may readily indicate to the user that the alert 200 is present. In a second exemplary embodiment, the alert 200 may be presented in a predetermined location on the stranded aircraft interface 105. For example, the interface 105 may include an empty location on a lower right corner reserved for displaying any alerts.

In a second exemplary embodiment, the alert 200 may be associated with a set of data pertaining to a particular aircraft. Thus, when a user selects the aircraft that is part of the stranded aircraft interface 105, the alert 200 may be attached thereto. The selection may cause the stranded aircraft interface 105 to present the alert 200 in a substantially similar manner as those discussed above.

The alert 200 may present a variety of data to the user regarding the aircraft that is stranded. Default settings may be used to include a set of data. For example, as as shown in FIGS. 2A-2C, the data presented in the alert 200 may include a flight number 205, an origin and/or destination 310, a scheduled time of arrival and/or departure 315, an actual time of arrival and/or departure 320, and an estimated time 325 in which the aircraft is stranded. The alert 200 may further include an option to view all stranded aircrafts via a portal 330.

The stranded aircraft interface 105 may be configured according to a user preference. The above described data that is presented may be expanded or contracted as a function of the user's preference. For example, additional data may be shown if the user prefers to include this additional data such as aircraft type, a weather update, estimated location, etc. In another example, the default settings may be altered so that only the scheduled time of arrival 315, the actual time of arrival 320, and the estimated stranded time 325 are shown.

Figure 3:
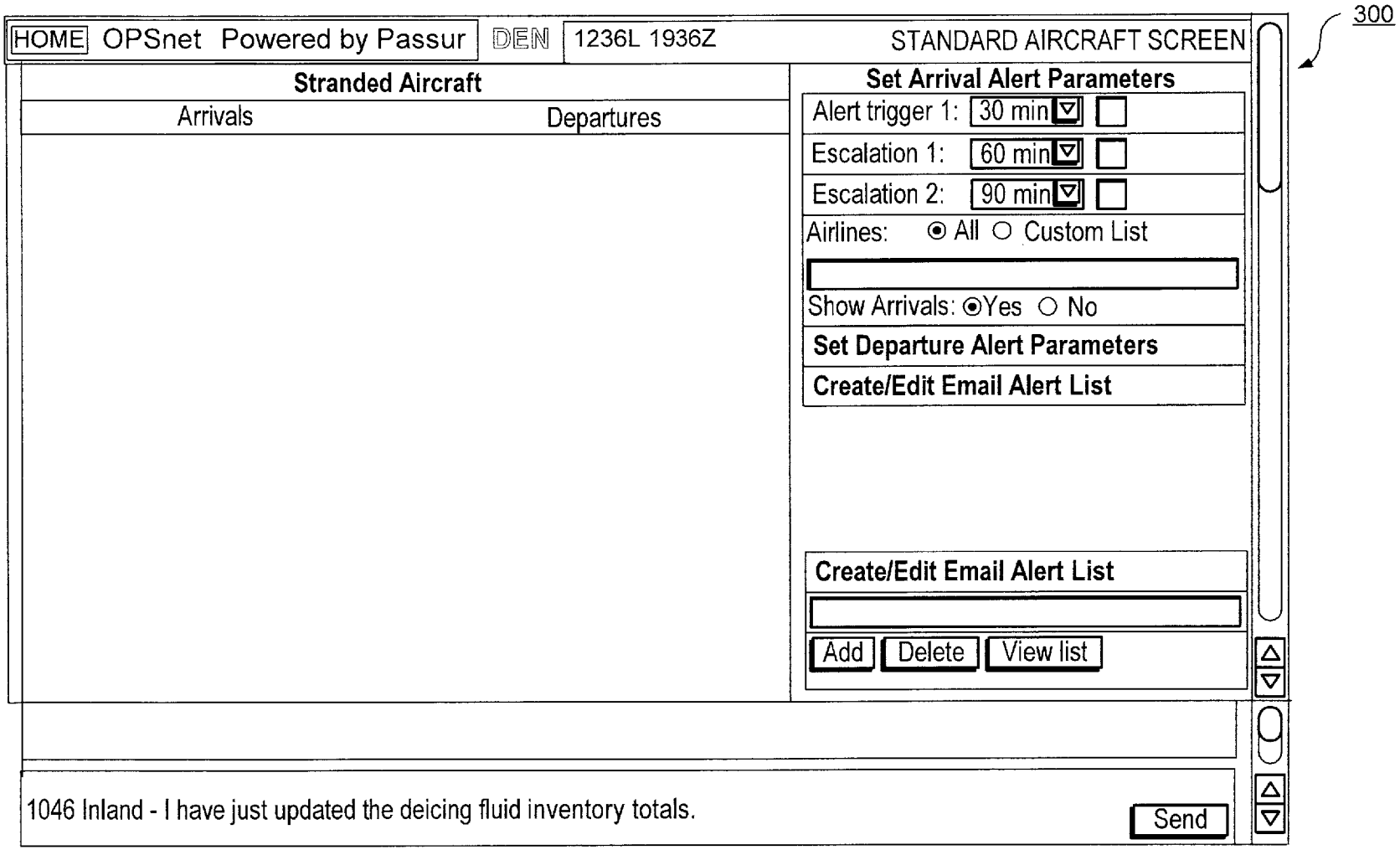
FIG. 3 shows a parameters interface including adjustable parameters for the alert of FIGS. 2A-2C according to an exemplary embodiment of the present invention.

FIG. 3 shows a parameters interface 300 including adjustable parameters for the alert 200 of FIGS. 2A-2C according to an exemplary embodiment of the present invention. The parameters interface 300 may be related to when the alert 200 is automatically generated when an aircraft is determined to be stranded. The parameters may include an initial time in which the alert 200 is presented. For example, the initial time may be 30 minutes. Thus, upon the aircraft being determined to be stranded for at least 30 minutes, the alert may be presented. The parameters interface 300 may also include further escalation times in which the alert 200 is to be shown. For example, a first escalation time may be 60 minutes after the aircraft is determined to be stranded while a second escalation time may be 90 minutes. The initial time and escalation times may be adjustable according to a user's preference.

The stranded aircraft alerts module may also be adjustable so that different types of alerts may be presented for arriving and departing flights. For example, when the alert 200 is superimposed on the stranded aircraft interface 105, for arriving flights, the alert 200 may be presented with a first background color (e.g., blue) while for departing flights, the alert 200 may be presented with a second background color (e.g., red). In another example, when the alert 200 is presented at a predetermined location of the stranded aircraft interface 105, the alert 200 may be presented in a lower right corner for arriving flights while the alert 200 may be presented in a lower left corner for departing flights.

The stranded aircraft alerts module may further be equipped to generate remote alerts for users, in particular, passengers. For example, the remote alerts may be embodied in an e-mail of the passengers. Passengers associated with a first alert of a first flight may be grouped as a first e-mail distribution list. Passengers associated with a second alert of a second flight may be grouped as a second e-mail distribution list. Thus, if the first flight has an alert generated and, thus, associated therewith, the first e-mail distribution list may be accessed and an e-mail alert may be sent accordingly. A substantially similar process may be performed when the second flight has an alert generated and associated therewith.

The stranded aircraft alerts module may also enable authorization for specific users. The authorization level of a user may enable further options to be performed. For example, a first set of users may be grouped as "edit users" who are permitted to set an alert. A second set of users may be grouped as "alert only" who only receive and view alerts but are not permitted to set an alert. The first set of users may be, for example, airport managers while the second set of users may be, for example, passengers.

Figure 4A:
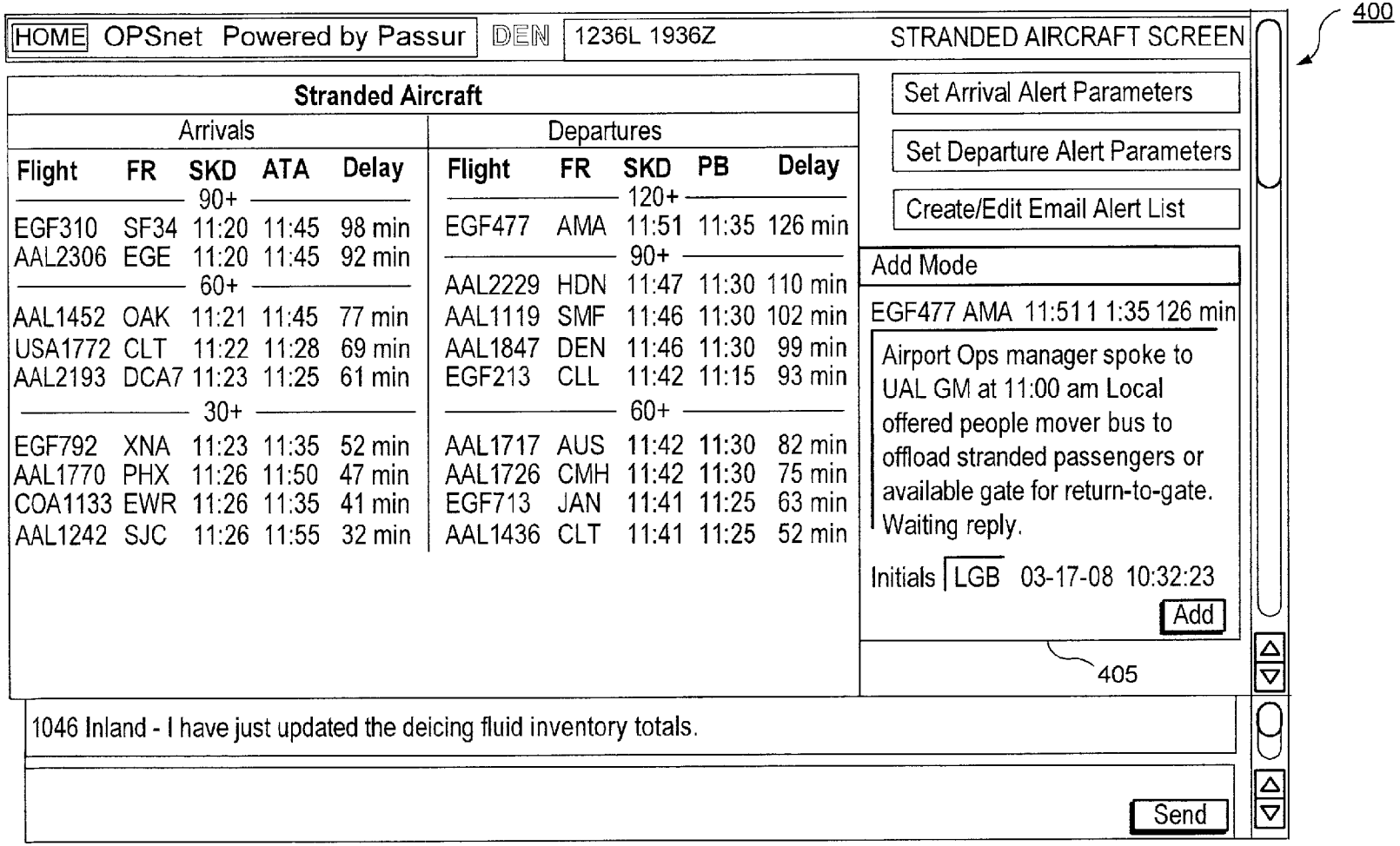
FIG. 4*a* shows another stranded aircraft interface in which a note is added for a set of data according to an exemplary embodiment of the present invention.
Figure 5B:
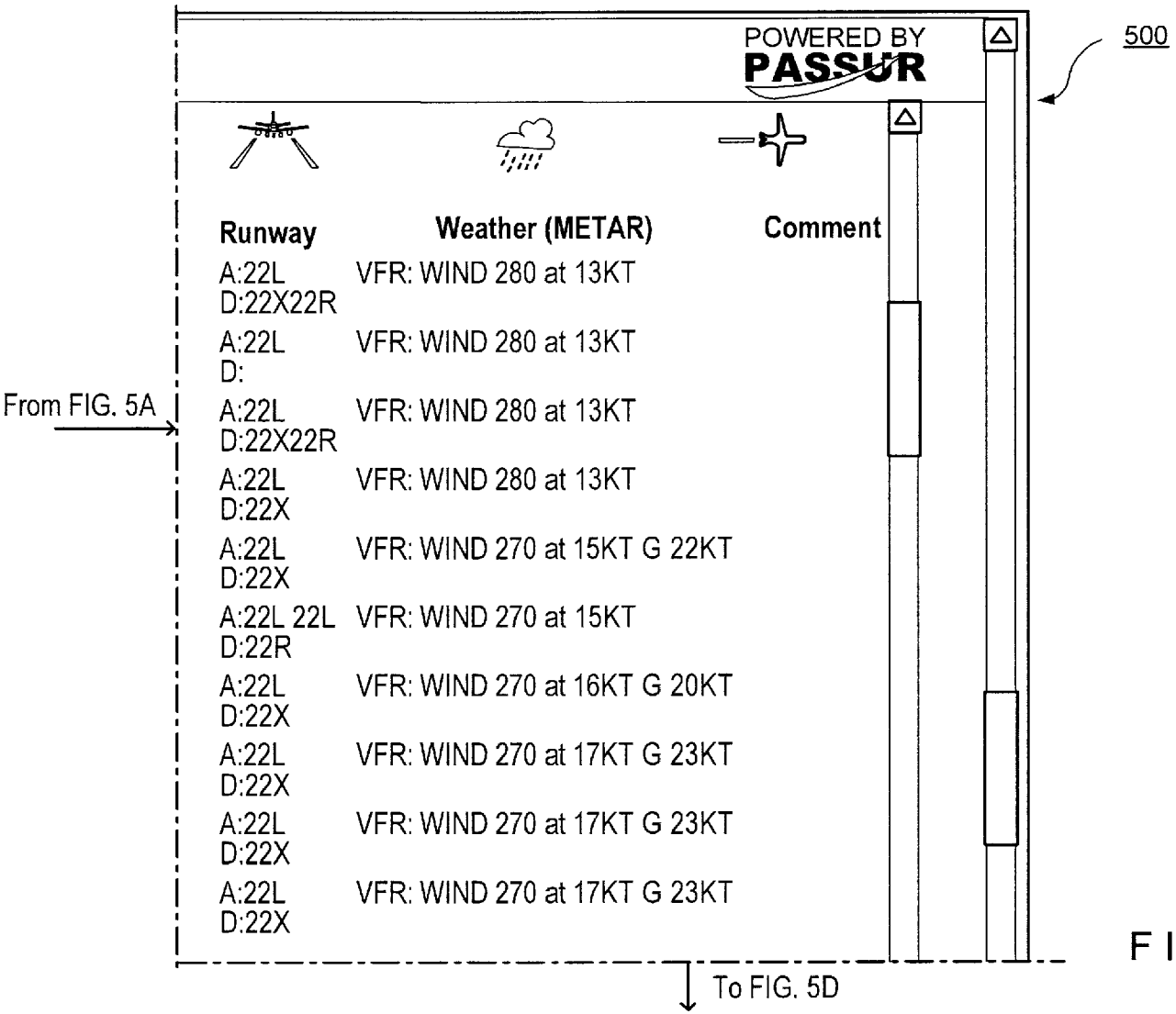
Figure 5D:
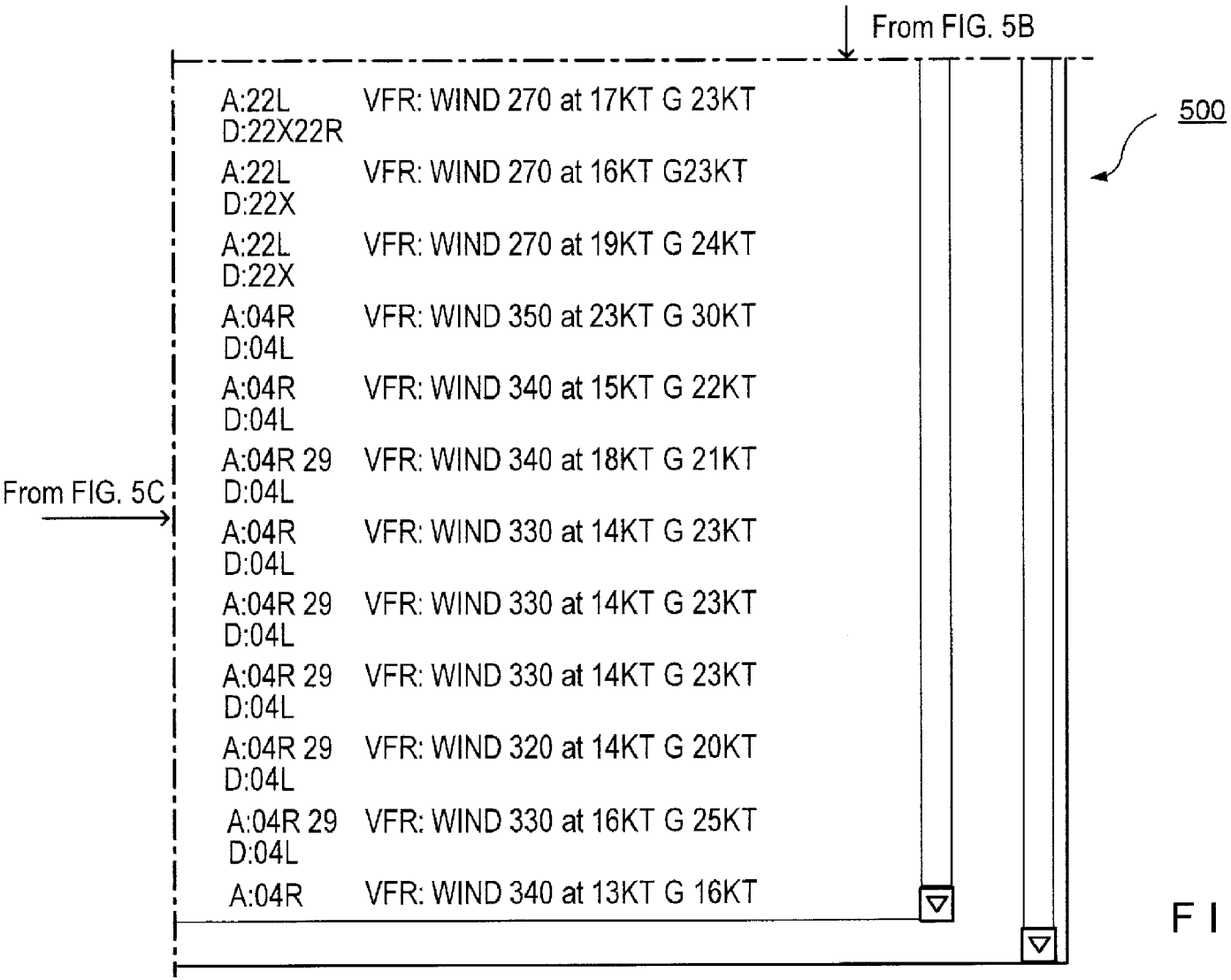
Figure 6B:
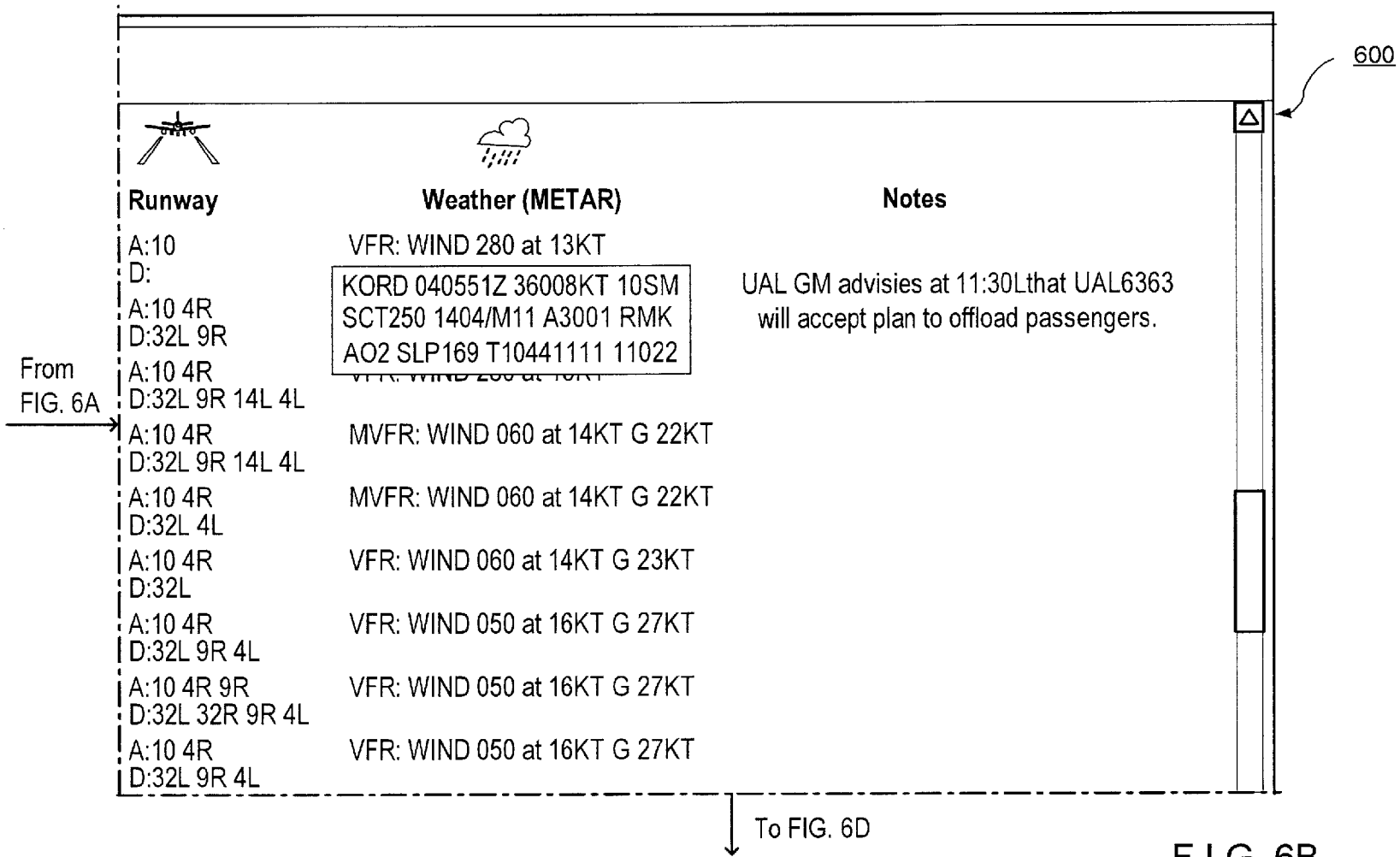
Figure 6D:
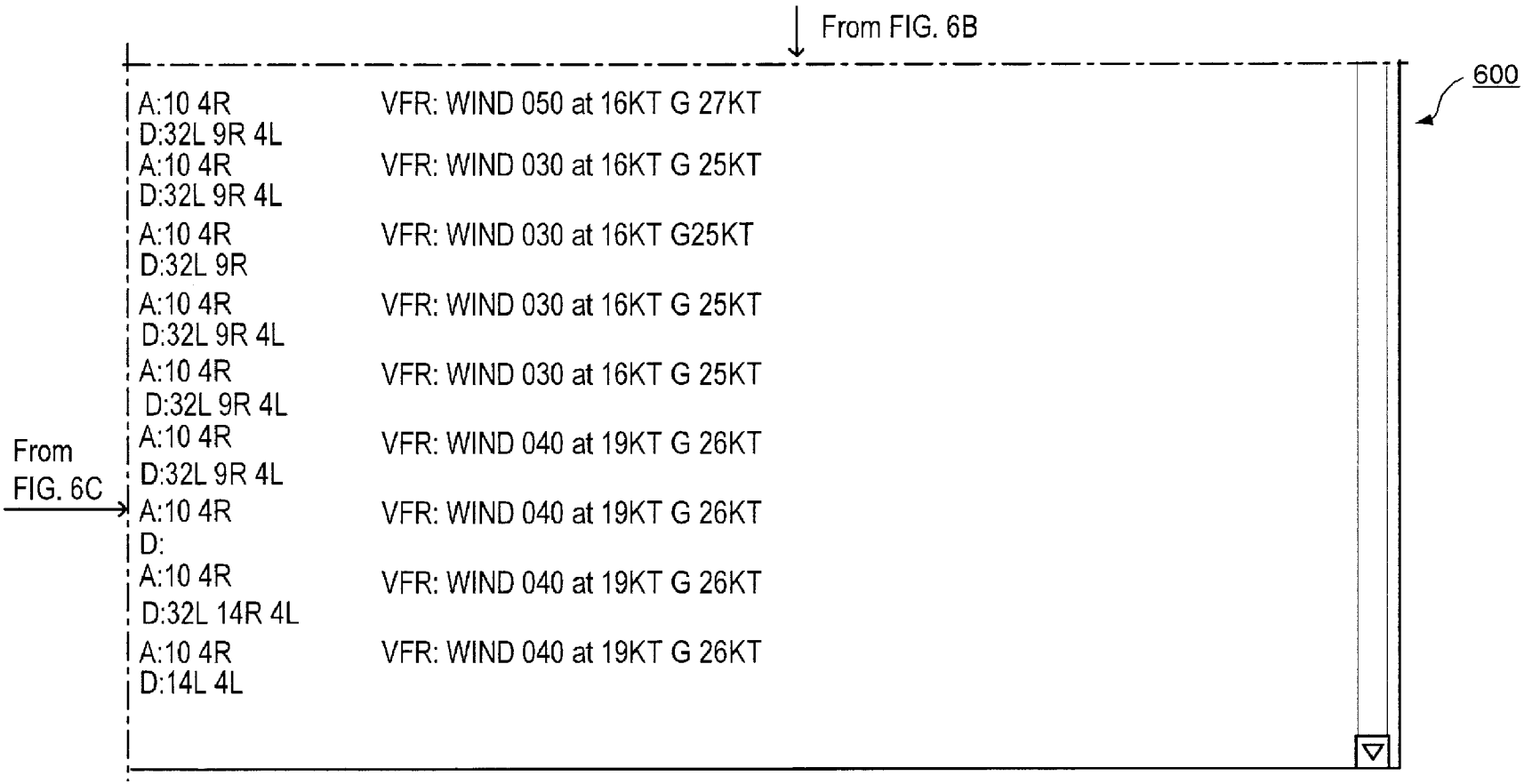

FIG. 4*a* shows another stranded aircraft interface 400 in which a note 405 is added for a set of data according to an exemplary embodiment of the present invention. The stranded aircraft interface 400 may show a set of arrival and departure flights that are organized according to a stranded time. As illustrated, the flight EGF310 and AAL2306 are categorized in the 90 minute stranded time while flights AAL14522, USA1772, and AAL2193 are categorized in the 60 minute stranded time. Each flight may be provided with an option in which the note 405 may be added. The note 405 may include additional data which may, for example, explain a reason for the stranded status. As illustrated, the flight EGF477 is shown to have the note 405 attached thereto for viewing if selected by the user. As discussed above, the stranded aircraft alerts module may grant authorization for the "edit users." These "edit users" may be allowed to set the note 405.

FIG. 4*b* shows an indication 410 of the note 405 for the set of data relating to the flight EGF477 of FIG. 4*a* according to an exemplary embodiment of the present invention. The indication 410 may be highlighted so that a user viewing the stranded aircraft interface 400 may readily recognize that a note has been attached thereto.

FIGS. 5A-5D show data 500 associated with the stranded aircraft alerts module according to an exemplary embodiment of the present invention. Specifically, the data 500 shown in FIGS. 5A-5D may embody a report for operational metrics associated with the stranded aircraft alerts module. The data 500 may correlate manually entered data with automated metrics that are derived from the manually entered data. The data 500 may be filtered so that a user-defined search may be performed. For example, an archive search option may be presented that may enable a user to enter a starting time and an ending time. Additional input may be entered such as an efficiency score, an arrival rate, a departure rate, a number of holds, arrival runway configurations, departure runway configurations, etc.

The data 500 of FIGS. 5A-5D may be used by the stranded aircraft alerts module to make determinations of whether an aircraft is currently stranded. For example, a column of the data 500 may indicate that an alert is presently attached with a particular flight. Furthermore, the data 500 may also be used to show whether an alert was ever attached to a particular flight. The data 500 may be stored as a database for future reference regarding past flights or present flights.

The data 500 may include a search option in which parameters may be entered to locate flights that match the criteria of the parameters. For example, the search option may enable a user to find all flights that have an alert associated therewith. In another example, a more narrow search may be used to find all flights departing from a particular airport that have an alert associated therewith. In yet another example, an ever narrower search may be used to find all flights departing of a particular aircraft type from a particular airport that have an alert associated therewith.

FIGS. 6A-6D show a summary 600 for the stranded aircraft alerts module according to an exemplary embodiment of the present invention. The summary 600 may incorporate all the data that has previously been described above to present a full disclosure regarding a particular flight including any additional notes (e.g., note 405) that been attached to the particular flight.

The summary 600 may enable an airport manager to efficiently schedule aircraft arrivals and departures by incorporating past stranded statuses. For example, the stranded aircraft alerts module may be configured to take average data from past schedules stored in the summary 600 to determine whether a particular time frame is expected to have an alert associated with a particular flight. In this manner, the airport manager may prepare for this condition by scheduling in a manner that may avoid the expected stranded status. If the scheduling that is chosen still results in a stranded status for the flight, further assessments may be made so that an alternate scheduling may be prepared for future flights with the expected stranded status.

Figure 7:
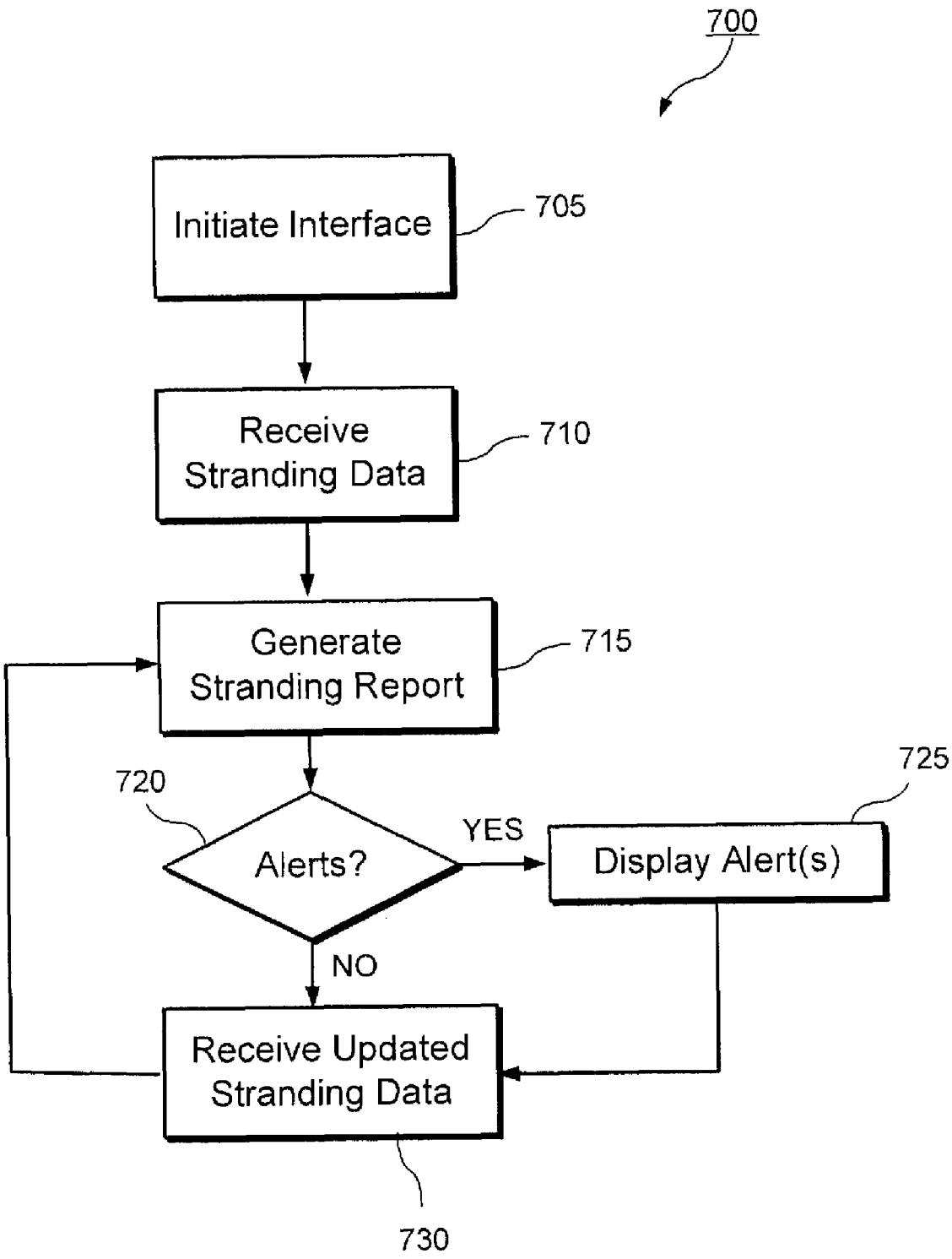
FIG. 7 shows a method for displaying alerts for stranded aircraft according to an exemplary embodiment of the present invention.

FIG. 7 shows a method 700 for displaying alerts for stranded aircraft according to an exemplary embodiment of the present invention. In step 705, the stranded aircraft interface 105 is initiated. As discussed above, the stranded aircraft alerts module may be incorporated into an existing system. The module may also be web-based in which a menu may be presented and an option may be available to access the stranded aircraft interface 105.

In step 710, data related to stranded aircraft is received. The data may also include aircraft that may potentially become stranded given a grounded time for that aircraft. For example, an aircraft may be grounded for a time that does not exceed a predetermined time that would indicate that the aircraft is stranded. Such aircraft may also be included in the data. Upon receiving the data, the method 700 continues to step 715 where a report is generated. The stranded aircraft interface 105 may show the report. The report may be substantially similar to the interface 400 shown in FIGS. 4*a-b*.

In step 720, a determination is made whether an alert exists. As discussed above, the alert may relate to an aircraft that is currently stranded to indicate to a user of this condition. Thus, in step 725, if an alert exists, the alert is displayed. As discussed above, the alert may be shown in a variety of locations such as being superimposed in a central location or shown in a predetermined location set aside for alerts.

In step 730, updated data relating to stranded aircraft is received and an updated report is generated. In this manner, the above described potential aircraft that may become stranded may have an updated status that they are stranded by being grounded beyond the predetermined time. A further iteration of the steps 720 and 725 will thereby indicate that another aircraft is now stranded so that an alert is generated.

The exemplary embodiments of the present invention a real-time tracking of alerts associated with stranded aircraft. The alerts enable an airport and its personnel such as airport managers to proactively assist airline carriers to prevent an extended stranding for an aircraft and its passengers by appropriately altering a scheduling that would alleviate the stranding. The alerts may also be presented to passengers to keep the passengers appraised of the situation. The data stored from the alerts of prior flights may subsequently be used by airport personnel to more efficiently address events that would anticipate a stranding of an aircraft. Consequently, the stranded aircraft alerts module may be able to properly respond to public demand and/or political efforts to mitigate the most severe and publicized aspects of stranded aircraft events.

The stranded aircraft alerts module may be easily implemented in existing systems to further incorporate the above described advantages for real-time alerting of passengers/airport personnel as well as providing back data of alerts to prepare for future anticipated alerts.

Those skilled in the art will understand that the above described exemplary embodiments may be implemented in any number of manners, including as a separate software module, as a combination of hardware and software, etc. For example, the stranded aircraft alerts module may be a program containing lines of code that, when compiled, may be executed on a processor. Specifically, the stranded aircraft alerts module may be a program of a server for a network in which data relating to stranded aircrafts is stored in a database of the network.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. An alerts module, comprising:

a memory storing current aircraft data and predetermined rules for determining whether an aircraft is stranded, the current aircraft data including identities of aircraft that are grounded and the predetermined rules including historical data of prior flights;

a processor comparing the current aircraft data to the predetermined rules for determining whether an aircraft is stranded and generating an alert for each of the aircraft that are determined to be stranded, wherein the alert includes the identify of the aircraft that is stranded.

2. The alerts module of claim 1, wherein the current aircraft data includes one of a block-out time, a wheels-up time, a block-in time, and a wheels-down time.

3. The alerts module of claim 2, wherein the processor determines one of a first time difference between a block-out time and a wheels-up time and a second time difference between a wheels-down time and a block-in time, wherein the one of the first time difference and second time difference is compared to the predetermined rules.

4. The alerts module of claim 1, wherein processor further generates a report including all aircraft determined to be stranded, the alert being one of superimposed on the report and located in a predetermined area of the report.

5. The alerts module of claim 1, wherein the alert shows at least one of a flight number, an origin, a destination, a scheduled time of arrival, a scheduled time of departure, an actual time of arrival, an actual time of departure, and an estimated stranded time.

6. The alerts module of claim 4, wherein the report further includes all currently grounded aircraft.

7. The alerts module of claim 4, wherein the report is configured to enable a note to be attached to at least one of the identities of the aircraft.

8. The alerts module of claim 1, wherein a first type of the alert is used for arriving flights and a second type of alert is used for departing flights.

9. The alerts module of claim 1, wherein the processor further generates a summary including all flights and any alert associated therewith.

10. The alerts module of claim 1, wherein the alert is distributed remotely to passengers associated with one of the identities of the aircraft that is stranded.

11. A computer readable storage medium including a set of instructions executable by a processor, the set of instructions operable to:

receive current aircraft data, the current aircraft data including identities of aircraft that are grounded;

receive predetermined rules for determining whether an aircraft is stranded, the predetermined rules including historical data of prior flights compare the current aircraft data to the predetermined rules for determining whether an aircraft is stranded; and generate an alert for each of the aircraft that are determined to be stranded, wherein the alert includes the identity of the aircraft that is stranded.

12. The computer readable storage medium of claim 11, wherein the instructions are further operable to:

generate a report as a function of the current aircraft data, the report including data related to the identities of the aircraft that are one of stranded and grounded.

13. The computer readable storage medium of claim 11, wherein the current aircraft data includes one of a block-out time, a wheels-up time, a block-in time, and a wheels-down time.

14. The computer readable storage medium of claim 13, wherein the comparing is one of a first time difference between a block-out time and a wheels-up time and a second time difference between a wheels-down time and a block-in time, and the predetermined rules.

15. The computer readable storage medium of claim 12, wherein the alert is one of superimposed on the report and located in a predetermined area of the report.

16. The computer readable storage medium of claim 11, wherein the alert shows at least one of a flight number, an origin, a destination, a scheduled time of arrival, a scheduled time of departure, an actual time of arrival, an actual time of departure, and an estimated stranded time.

17. The computer readable storage medium of claim 12, wherein the report is configured to enable a note to be attached to at least one of the identities of the aircraft.

18. The computer readable storage medium of claim 11, wherein a first type of the alert is used for arriving flights and a second type of alert is used for departing flights.

19. The computer readable storage medium of claim 11, wherein the instructions are further operable to:

generate a summary including all flights and any alert associated therewith.

20. The computer readable storage medium of claim 11, wherein the instructions are further operable to:

transfer the current aircraft data into the historical data of prior flights.

* * * * *